US009772117B2

(12) United States Patent
Feisthammel et al.

(10) Patent No.: US 9,772,117 B2
(45) Date of Patent: Sep. 26, 2017

(54) AIR-CIRCULATING MODULE AND FUME EXTRACTION DEVICE

(75) Inventors: Egon Feisthammel, Rastatt (DE); Steffen Renkema, Bretten (DE); Markus Wendland, Karlsruhe (DE)

(73) Assignee: BSH Hausgeräte GmbH, Munich (DE)

( * ) Notice: Subject to any disclaimer, the term of this patent is extended or adjusted under 35 U.S.C. 154(b) by 1016 days.

(21) Appl. No.: 12/497,774

(22) Filed: Jul. 6, 2009

(65) Prior Publication Data

US 2010/0012110 A1 Jan. 21, 2010

(30) Foreign Application Priority Data

Jul. 18, 2008 (DE) ..... 10 2008 033 792

(51) Int. Cl.
*B01D 50/00* (2006.01)
*F24F 13/02* (2006.01)
*F24C 15/20* (2006.01)

(52) U.S. Cl.
CPC ..... *F24F 13/0236* (2013.01); *F24C 15/2042* (2013.01)

(58) Field of Classification Search
CPC ..... B01D 50/00
USPC ..... 454/228; 126/299 R
See application file for complete search history.

(56) References Cited

U.S. PATENT DOCUMENTS 3,936,171 A 2/1976 Brooke
4,083,362 A * 4/1978 Bergmark et al. ..... 126/299 D
4,444,720 A * 4/1984 Mayer ..... 422/119
4,749,390 A * 6/1988 Burnett et al. ..... 96/57
4,946,480 A * 8/1990 Hauville ..... 96/117.5
5,176,570 A * 1/1993 Liedl ..... 454/309
5,256,104 A * 10/1993 Arold ..... 454/158
6,059,852 A * 5/2000 Olson ..... 55/495
6,234,893 B1 * 5/2001 Meredith ..... 454/289
6,257,976 B1 * 7/2001 Richardson, III ..... 454/309
6,299,525 B1 * 10/2001 Scheffler et al. ..... 454/76
6,371,846 B1 * 4/2002 Powell et al. ..... 454/271
6,406,257 B1 * 6/2002 Houdek ..... 415/213.1
6,533,835 B2 * 3/2003 Wilson et al. ..... 55/481
6,592,449 B2 * 7/2003 Cipolla et al. ..... 454/184
6,623,538 B2 * 9/2003 Thakur et al. ..... 55/385.2
6,814,660 B1 * 11/2004 Cavett ..... 454/284
6,826,048 B1 * 11/2004 Dean et al. ..... 361/695
6,835,128 B1 * 12/2004 Olson ..... 454/232
7,251,135 B2 * 7/2007 Crippen et al. ..... 361/695
7,300,485 B1 * 11/2007 Moore et al. ..... 55/385.6
7,323,027 B1 * 1/2008 Fu ..... 55/385.6
7,352,574 B2 * 4/2008 Chen ..... 361/695
8,460,419 B1 * 6/2013 Hobbs ..... 55/385.2
8,597,390 B2 * 12/2013 Aizawa et al. ..... 55/481
8,773,853 B2 * 7/2014 Tsai et al. ..... 361/695
(Continued)

FOREIGN PATENT DOCUMENTS

DE 4410884 C2 9/1997
DE 10216012 A1 10/2003
(Continued)

*Primary Examiner* — Steven B McAllister
*Assistant Examiner* — Samantha Miller
(74) *Attorney, Agent, or Firm* — Michael E. Tschupp; Andre Pallapies

(57) ABSTRACT

An air-circulator includes an housing with an air inlet, an air outlet opening, an odor filter, and an insertion opening for inserting the odor filter. The odor filter is assigned to the air outlet opening.

13 Claims, 7 Drawing Sheets

(56) References Cited

U.S. PATENT DOCUMENTS

| | | | | |
|---|---|---|---|---|
| 8,814,144 | B2 * | 8/2014 | McTaw, Jr. | 254/330 |
| 9,132,373 | B2 * | 9/2015 | Loggins et al. | |
| 2003/0126992 | A1 * | 7/2003 | Volo et al. | 96/134 |
| 2005/0235620 | A1 * | 10/2005 | Connor et al. | 55/498 |
| 2006/0102550 | A1 * | 5/2006 | Joseph et al. | 210/464 |
| 2008/0113598 | A1 * | 5/2008 | Pucciani | 454/56 |
| 2008/0202491 | A1 | 8/2008 | Eberhard | |
| 2008/0305731 | A1 * | 12/2008 | Reid et al. | 454/65 |
| 2013/0097981 | A1 * | 4/2013 | Harris | 55/495 |

FOREIGN PATENT DOCUMENTS

| | | | |
|---|---|---|---|
| DE | 202004005942 | U1 | 9/2005 |
| DE | 202006016179 | U1 | 4/2008 |
| EP | 0915299 | A2 | 5/1999 |

* cited by examiner

AIR-CIRCULATING MODULE AND FUME EXTRACTION DEVICE

BACKGROUND OF THE INVENTION

The present invention relates to an air-circulator and a fume extractor, in particular to an air-circulating fume extractor, which particularly preferably constitutes a suction area, extending vertically in relation to a cooking area, with a downwardly oriented suction duct attached to the suction area.

When fumes and steam are sucked out of a room, in particular a kitchen, it is known for the sucked contaminated air to be cleaned by means of a grease filter. In air-circulating fume extractors, the air cleaned in this manner is not, as in the case of air-extracting fume extractors, routed to the outside, but is emitted into the room in which the fume extractor is in operation. For this reason, the requirements in terms of the purity of the emitted air are particularly high. In particular, it is essential that odorants be removed from the air which is pre-cleaned by the grease filter. This cleaning of the air which has been pre-cleaned by the grease filter is usually carried out by odor filters, which can, for example, be active carbon filters.

BRIEF SUMMARY OF THE INVENTION

Particularly in fume extractors in which the air to be cleaned is sucked in via a vertical intake opening, guided via a grease filter and guided into a downwardly extending exhaust duct, the arrangement of the odor-eliminating filters, which are referred to as odor filters, presents a problem. The location at which the odor filters have to be provided is not normally readily accessible to the user, so changing the odor filters may be associated with a major outlay in terms of dismantling. Moreover, an exhaust-air duct in which the odor filter can be provided usually takes up a large area of the space that is available below the intake opening, for example in the cabinet in which a hob is provided.

An object of the present invention is therefore to create a solution by means of which reliable cleaning of the air to be emitted into the room can be ensured and which is nevertheless easy to manage.

An exemplary embodiment of the invention is based upon the recognition that this object can be achieved by bringing the odor-eliminating filter from outside into the space in which the air, preferably pre-cleaned by the grease filter, is introduced.

According to a first aspect, the invention is achieved in an air-circulator for use with a fume extractor which has an housing with an air inlet, an air outlet opening, and an odor filter. The housing has an air outlet opening and additionally an insertion opening for inserting one of the odor filters, and in that an odor filter is assigned to each air outlet opening.

Within the meaning of the present invention, an air-circulator designates a receptacle into which pre-cleaned air can be introduced and treated by odor filters. The air-circulator can be used with different types of fume extractors. The air-circulator is used particularly preferably with a fume extractor which sucks fumes and steam away from a hob via a suction area which is arranged adjacent to the hob. Here, the suction area or the suction areas can be arranged next to or behind the hob.

The odor filter according to the present invention preferably constitutes a filter unit in the form of a cartridge, plate or pad. The filter material may be active carbon, zeolite or another odor-eliminating material. Particularly preferably, the odor filter has a flat planar form.

The air outlet opening of the air-circulator designates an opening via which the air can pass from the air-circulator indirectly or directly into the room in which the fume extractor is in operation. This room is, for example, a kitchen. The air outlet opening is normally covered by a protective grid or air-guiding grid. The grid is therefore also referred to as the air outlet opening.

The assignment of an odor filter to an air outlet opening signifies within the meaning of the present invention that air is guided through the odor filter before reaching the corresponding air outlet opening. To this end, each of the odor filters preferably covers a corresponding air outlet opening, i.e. the area defined by this air outlet opening. Here, the odor filter can be arranged immediately in front of the air outlet area or at a distance from the air outlet area.

In that, in the air-circulator according to the invention, an insertion opening is provided for inserting the odor filter, which insertion opening is separate from the air outlet opening, the odor filter can be introduced into the air-circulator from outside without having to intervene in the air-circulator through the air outlet opening. Furthermore, the insertion opening also enables access to the odor filter without the need to dismantle the air-circulator. Dismantling of a lid or of another component of the air-circulator which is connected to the housing, for example by means of a screw connection, is not necessary in the case of the air-circulator according to the invention.

In comparison to known air-circulators, the air-circulator according to the invention is constructed in a substantially simpler manner, and assembly of the air-circulator and insertion and removal of the odor filter or filters is simplified.

The size of the insertion opening preferably corresponds to the cross section of the odor filter. The odor filter is preferably rectangular in form. The length and height of the odor filter correspond to the length and width of the insertion opening. Here, the height of the odor filter designates the dimension of the odor filter which lies in the direction in which air to be cleaned flows through the odor filter. This dimension corresponds to the dimension of the smallest length of the odor filter. The insertion opening preferably constitutes a slot. The width of the odor filter is preferably chosen so as to correspond to the dimensions of the air outlet opening or to the height of the housing.

The dimensions of the insertion opening correspond to the cross section of the odor filter, i.e. the dimensions of the odor filter which lie in this cross section, in particular the length and height of the odor filter correspond to the length and width of the insertion opening, this odor filter can be introduced into the air-circulator from outside through the insertion opening and the greatest area, defined by the length and width of the odor filter, can be available in the air-circulator. Furthermore, in the embodiment in which the dimensions of the insertion opening are adapted to those of the odor filter, locking or sealing of the insertion opening is possible with little effort. For example, a sealing strip or sealing bar can be introduced into the insertion opening. This sealing strip or bar is preferably connected to the lid, i.e. fastened thereto, before the odor filter is introduced. The odor filter is then introduced into the housing through the sealing strip. Particularly where the insertion opening is embodied as a slot, closing and sealing is possible by means of simple components without these having to be fastened to the housing in a time-consuming manner, for example by screwing.

Furthermore, in the embodiment in which the insertion opening embodies a slot, it is advantageous that access to the odor filter via the edge thereof is enabled. To change the filter, the user does not therefore have to touch the surface of the odor filter, via which cleaning of the air principally takes place.

According to a preferred embodiment, a handle, for example in the form of a tab, is provided on an edge of the odor filter. The provision of a handle further simplifies the insertion and the removal of the odor filter from the air-circulator. The handle is preferably provided on the edge which, when the odor filter has been placed in the air-circulator, faces in the direction of the insertion opening or lies in the insertion opening.

The insertion opening is preferably positioned in the top of the housing. The top of the housing designates within the meaning of the invention the side which, in the assembled position, faces upwards. This arrangement of the insertion opening of the air-circulator makes it possible for the air-circulator to be admitted into a closed space and installed there. Only the top of the air-circulator has to be accessible to the user in this embodiment. Via the top, the user can obtain access to the insertion openings and thus to the odor filter or filters.

According to one embodiment, the air-circulator has an air inlet. The air inlet is preferably provided on the side of the housing on which the insertion opening is also positioned. In one embodiment, the air inlet is provided on the top of the housing. The arrangement of the insertion opening or openings on the same side on which the air inlet is also provided means that the other sides of the air-circulator are available for other purposes. Thus, in a box-shaped air-circulator, for example, all the lateral surfaces can serve as air-outlet openings. Enlargement of the air-outlet area makes it possible for the airflow generated by the exiting air to be reduced in intensity and thereby to prevent unpleasant draught effects for the user. In addition, the arrangement of the air inlet on the side of the air-circulator on which the insertion opening or openings are also provided is advantageous for the assembly and dismantling of the air-circulator. Since the side with the insertion openings has to be accessible to the user for access to the odor filters, the air inlet is also readily accessible.

Furthermore, in an air-circulator which is arranged in a closed space and in which only the side in which the insertion openings are provided is accessible, the need to provide a separate passage to the closed for a feed line to the air inlet can be dispensed with. The closed space can, for example, be the plinth of a base unit in a line of kitchen units.

According to a preferred embodiment, the housing has a guiding profile for guiding an odor filter in the air-circulator. The integration of a guiding profile in the housing of the air-circulator makes it possible for the position of the odor filter relative to an air-outlet area and other components of the air-circulator, such as, for example, a fan provided in the air-circulator, to be guaranteed, i.e. the odor filter can be held in this position. In addition, a guiding profile facilitates the insertion of an odor filter into the air-circulator.

According to a particularly preferred embodiment, the guiding profile has a carrier for guiding a protective grid. The protective grid preferably represents an intervention protection grid by which intervention in the air outlet opening is prevented. In that the guide for such a protective grid is preferably provided together with the guide for the odor filter on the guiding profile, the relative position between these two components is fixed. In addition, guiding of the protective grid on the same guiding profile on which the guide for the odor filter is also provided, simplifies the structure of the air-circulator. In particular, the number of components, and thus assembly and storage, is simplified.

Fixing devices for fixing the guiding profile in the air-circulator and preferably for connecting to components of the air-circulator are particularly preferably additionally provided on the guiding profile. These fixing devices can be screw receivers or locking devices. Via these fixing devices, the guiding profile can be fastened, for example, to a floor or lid of the housing of the air-circulator. In this way, the floor of the housing which is preferably embodied as a base pan and includes a part of the side walls, can be connected via the guiding profile to a lid of the housing of the air-circulator. In this embodiment, the need for additional fixing devices or fasteners for the individual components of the air-circulator can consequently be dispensed with and the design is further simplified.

The housing of the air-circulator preferably includes a lid which has a fastener for fastening to the top of a floor of a cabinet. The top of the floor is designated here as being the side of a plate that forms the floor which is facing the interior of the cabinet. The fastener preferably constitutes one or more lugs which extend outwardly from the edge of the lid. In that the lid of the air-circulator can be fastened to the floor of a cabinet, it will be possible to introduce the air-circulator from above into the floor of the cabinet and thus into a space located under the floor, for example a plinth space, and then to fasten it to the top of the floor. This is advantageous since below the floor of a cabinet, in particular a floor cabinet of a line of kitchen units, as a rule only a plinth that has a low height is provided. Introducing the air-circulator for assembly in the plinth via the front or one of the sides of the plinth is difficult or even impossible on account of the low height of the plinth. By contrast, the air-circulator according to the invention, in which a fastener is provided on the lid, can be assembled from the interior of the cabinet and then fixed by means of the lid to the floor.

According to one embodiment, the housing of the air-circulator includes a base part which has a height which corresponds to the height of a plinth of a cabinet. The base part is particularly preferably slightly higher than the height of the plinth. This makes it possible to place a lid onto the base part while the base part has already been introduced into the plinth. The height of the base part is determined in the air-circulator according to the invention by the strength of the floor plate and the height of the side walls. The side walls can be formed here by plates which are embodied in one piece with the floor plate and cover the entire side area of the air-circulator. It is, however, also possible for the sides of the air-circulator to be formed of strips which extend on the edge of the side area and between which the air outlet opening of the air-circulator is formed. Finally, it is also possible for the sides of the air-circulator to be formed on their edges by the guiding profile for guiding the odor filter and grid.

The division of the air-circulator into base part and lid makes it possible for individual components of the air-circulator to be specifically assigned to the one or other component. The sides and the floor of the air-circulator, in which the air-outlet openings are provided at least in part, the guiding profiles and optionally provided protective grids are preferably assigned to the base part. As a result, the structure of the lid is simple and handling and assembly is easy for the user.

According to one embodiment, the air-circulator includes a fan which is accommodated in the housing of the air-circulator. The integration of a fan into the air-circulator further increases the fields of application of the air-circulator. The fan or the blower is integrated within the air-circulator such that, by means of the fan, air is sucked into the air inlet of the air-circulator. This makes it possible for the air-circulator to be connected directly to a suction area of a fume extractor. The provision of a separate blower of the fume extractor between the suction area and the air-circulator is not necessary in this embodiment. Since the air-circulator is preferably positioned in the plinth of a base unit, the noise generated by the fan is also suppressed by this means. Consequently, if a separate blower for the fume extractor is dispensed with, noise generation can be minimized overall. Furthermore, if a fan is provided in the air-circulator, the distance of the fan from the odor filter(s) is minimized. By this means, the air sucked in via the fan is reliably guided to the odor filters and through these. Finally, where the fan is integrated in the air-circulator, it is also possible for the connection to be implemented to multiple suction areas which are optionally provided at different locations.

According to one embodiment, the air-circulator therefore has more than one air inlet, for example two air inlets. In this embodiment, the air-circulator can be connected for example to suction areas, one of which is arranged to the left and the other to the right of a hob.

According to a further embodiment, the air outlet opening is located at a distance from the housing. In this case, a feeder pipe or feeder hose can be provided on the housing, leading to an air outlet opening located at a distance. In this embodiment, the cleaning of the air in the housing of the air-circulator is preferably carried out by means of odor filters and only the cleaned air guided to the air outlet opening. The air outlet opening can include an air receptacle into which the air is guided via the feeder pipe. This air receptacle is formed on one side by a grid or another air-permeable material and constitutes the actual air-outlet opening or air-outlet area. The air-outlet area may for example be arranged in the wall of a plinth of a base unit. In this embodiment, the air conveyance in the interior of the plinth is closed and the insides of the plinth are thus not immediately exposed to an airflow. This prevents contamination of the inside of the plinth.

According to a further aspect, the invention relates to a fume extractor for sucking out and cleaning contaminated air from a room, including a suction area and an air supply line to an air-circulator with an air inlet and an air-outlet opening. The fume extractor is characterized in that the insertion opening for inserting an odor filter is additionally provided on the air-circulator.

The air-circulator is preferably detachable from the fume extractor. In that the air-circulator can be separated from the fume extractor, this module can be flexibly installed to suit the spatial conditions of the installation location and connected to the suction area or areas of the fume extractor. In that the air-circulator is embodied as a separate unit, this module can be provided, for example, in a base unit which is adjacent to the base unit in which a suction area is provided. In this way, the air cleaned by the odor filter does not emerge at a point at which the user of the fume extractor is positioned.

According to one embodiment, the air-circulator includes a fan that sucks air in via the suction area or areas of the fume extractor. Integration of the fan for sucking in the air via the suction area into the air-circulator of the fume extractor enables the arrangement of the suction area or areas to be freely selected. The fan of the air-circulator serves in this embodiment simultaneously to suck the air into the air-circulator and to blow the cleaned air out of the air-circulator.

According to one embodiment, the fume extractor comprises a vertical suction area with a downwardly pointing air duct connected thereto. This fume extractor, in which the suction areas are provided, for example, behind or alongside a cooking area, is also referred to as a down-draft fume extractor.

According to one embodiment, the fume extractor is installed in a base unit of a line of kitchen units and the air-circulator is integrated in the plinth of one of the base units of the line of kitchen units. In this embodiment of the fume extractor it is particularly advantageous that the air-circulator is integrated in a space-saving manner into the base unit. The housing of the air-circulator is in this case accommodated in the plinth of one of the base units of the line of kitchen units. Only the lid of the housing can, according to one embodiment, project into the interior of the base unit. The remaining interior of the base unit is available as storage space. The insertion openings provided on the air-circulator for odor filters, which are preferably inserted on the top of the air-circulator mean that these continue to be easily accessible to the user even after installation of the air-circulator.

The fume extractor according to the invention preferably includes an air-circulator according to the present invention.

Features and advantages which are described with respect to the air-circulator according to the invention shall—where applicable—apply analogously to the fume extractor according to the invention and vice versa.

BRIEF DESCRIPTION OF THE DRAWINGS

The invention will be described afresh with the aid of the accompanying drawings, in which.

DETAILED DESCRIPTION OF THE PRESENT INVENTION

Figure 1:
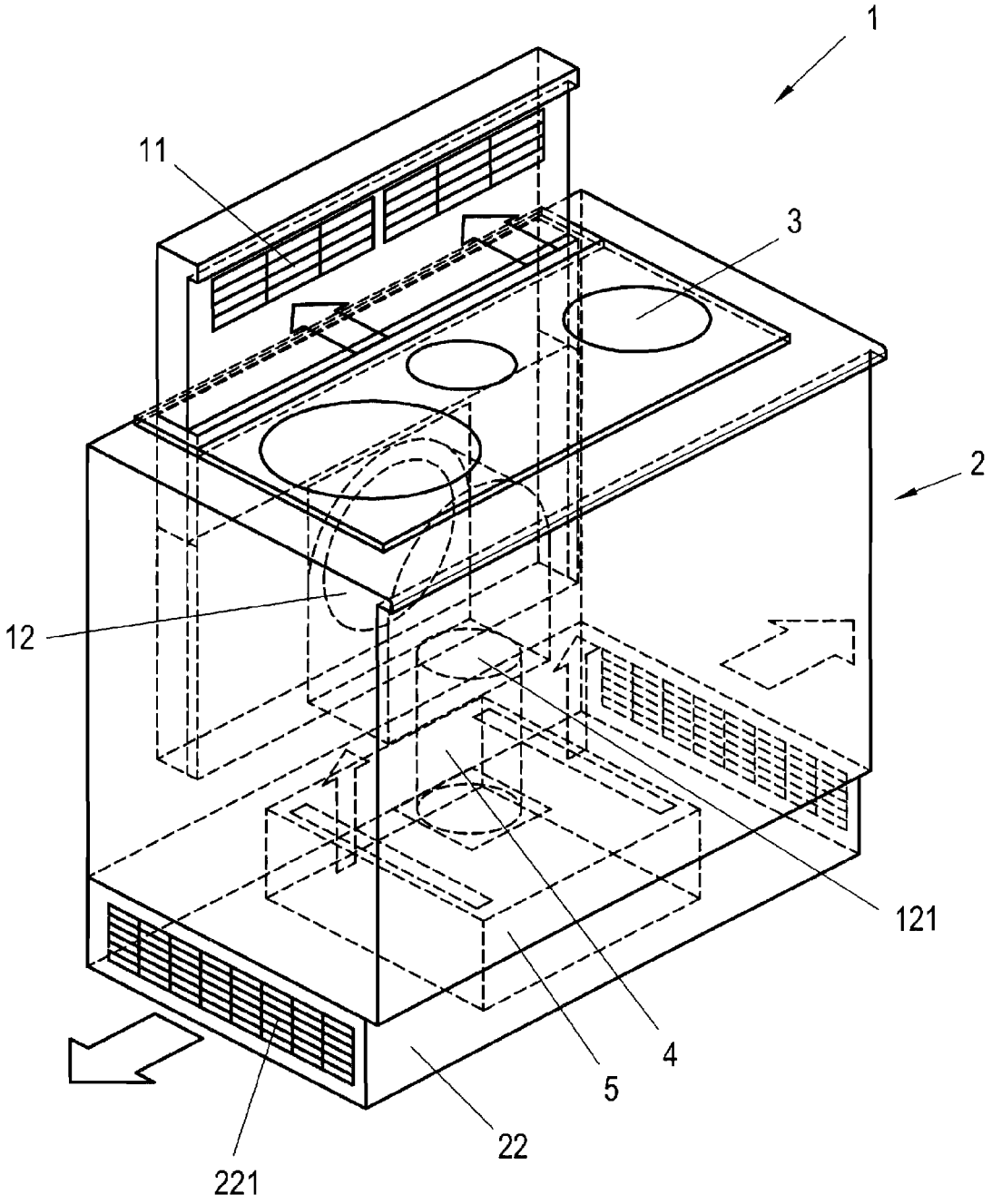
FIG. 1: shows a schematic perspective view of a fume extractor according to the invention in a kitchen base unit.

Shown in FIG. 1 is a schematic perspective view of an embodiment of a fume extractor 1 according to the invention. The fume extractor 1 is accommodated in a base unit 2. This may, for example, be the base unit 2 of a line of kitchen units. Furthermore, a hob 3 is set into the top of the base unit 2. The fume extractor 1 is arranged such that the suction area 11 of the fume extractor 1 extends in a vertically upward manner and is arranged behind the hob 3. A grease filter (not shown) is provided in the suction area 11 or behind the suction area 11. From the suction area 11, the fume extractor 1 runs in a vertically downward manner into the base unit 2. The blower 12 of the fume extractor 1 is arranged in the interior 21 of the base unit 2 below the hob 3. An air line 4 is connected to the blower 12, i.e. to the air outlet 121 of the blower 12. This air line leads from the blower 12 to an air-circulator 5. The air-circulator 5 is arranged in the plinth 22 of the base unit 2. In the embodiment shown, air grids 221 are provided on the side walls of the plinth 22, via which air grids the air can be emitted into the space in which the fume extractor 1 is operated. The fume extractor 1 shown, in which the air sucked in via the suction area 11 is conveyed further in a downward manner, is also referred to as a down-draft fume extractor.

Figure 2:
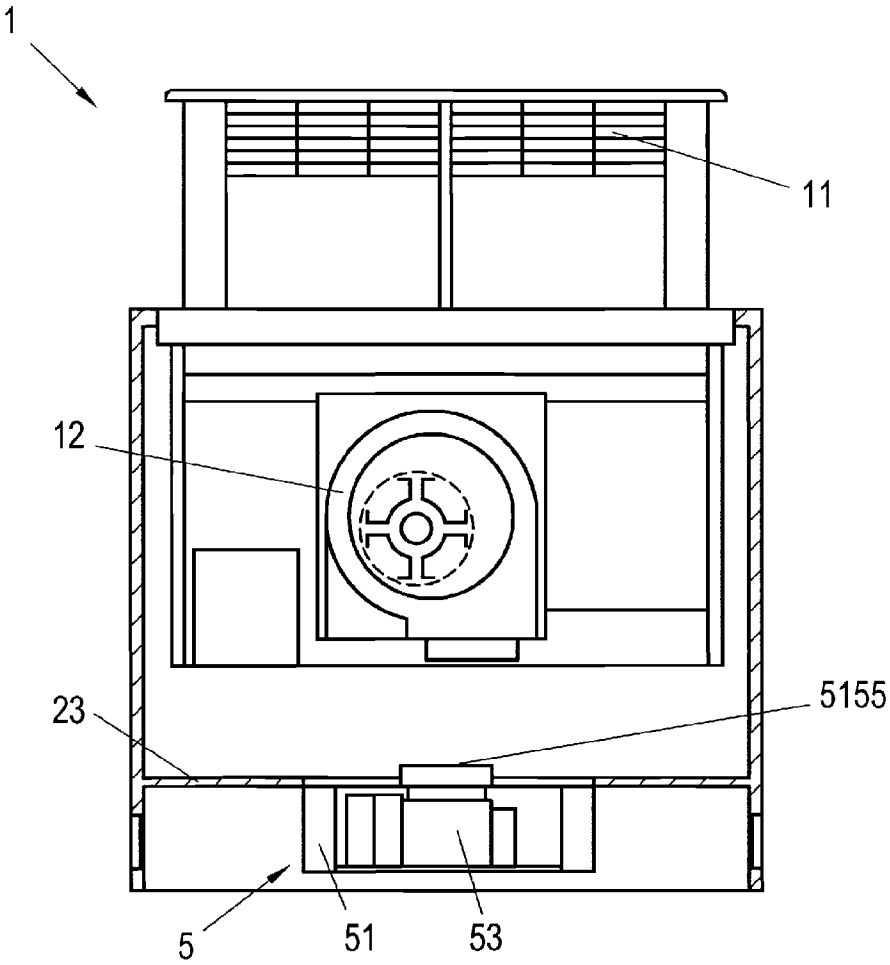
FIG. 2: shows a schematic sectional view of the fume extractor according to FIG. 1.

The sectional view of the fume extractor 1 in FIG. 2 shows a section through the fume extractor 1 and the base unit 2 along a line of intersection which lies parallel to the back wall of the base unit 2 and in the embodiment shown thus parallel to the suction area 11 of the fume extractor 1. As is evident from the view, the blower 12 of the fume extractor 1 is arranged in relation to the floor 23 of the interior 21 of the base unit 2 at a distance above the floor 23. This distance is bridged by means of an air line 4, which can be embodied as a hose, pipe or duct and is not shown in FIG. 2. Here, the air line 4 (see FIG. 1) is connected at the one end to the air outlet 121 of the blower 12 and at the other end to a pipe socket 5155 of the air-circulator 5. In the embodiment shown, a fan 53 is arranged in the air-circulator 5. This fan is accommodated in the housing 51 of the air-circulator 5. The more precise structure of the air-circulator 5 will be described in greater detail later with reference to FIGS. 4 to 14. In the embodiment shown, the fan 53 consequently serves as an additional blower to the blower 12 of the fume extractor 1.

Figure 3:
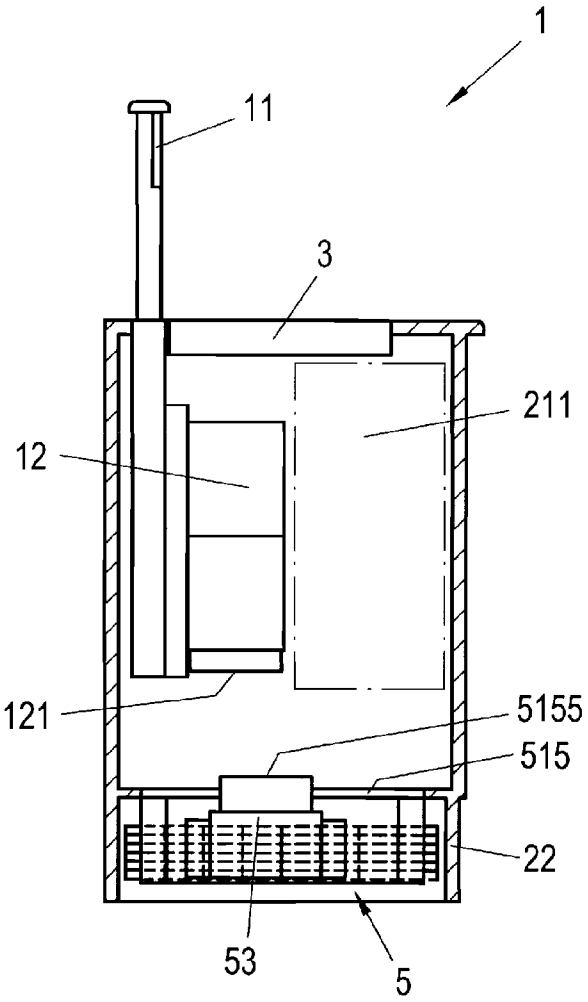
FIG. 3: shows a schematic sectional view of the fume extractor according to FIG. 1.

Shown in FIG. 3 is a further sectional view of the fume extractor 1 and the base unit 2. Here, the cross-sectional line is perpendicular to the back wall of the base unit 2. In this view, the storage space 211 available in front of the blower 12 and above the air-circulator 5 in the interior 21 of the base unit 2 is indicated schematically.

Figure 5:
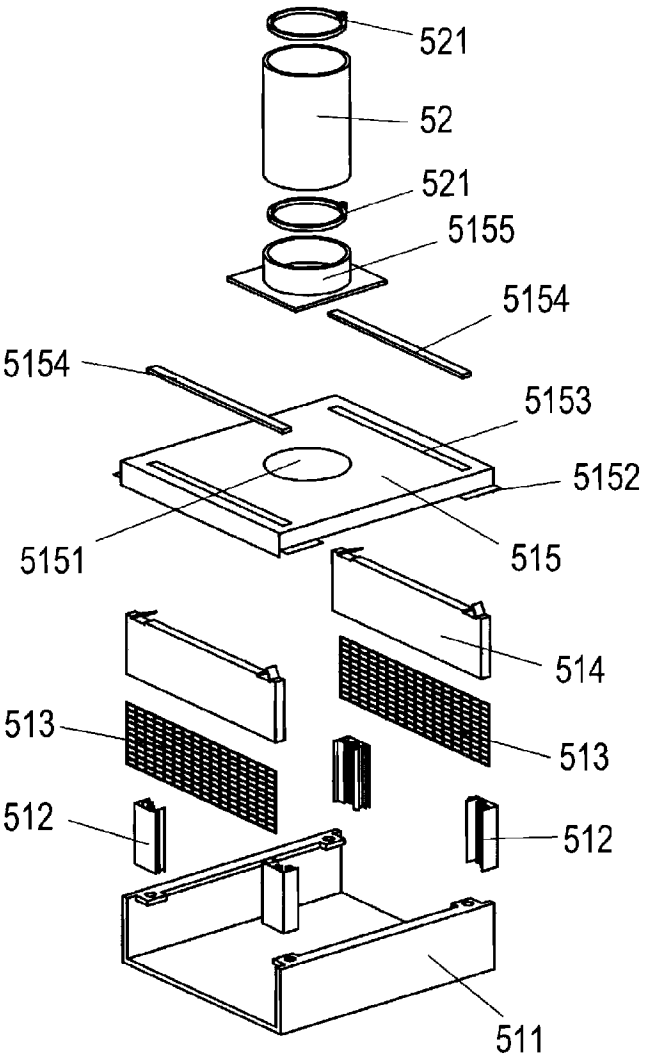
FIG. 5: shows a schematic exploded view of the embodiment of the inventive air-circulator according to FIG. 4.
Figure 4:
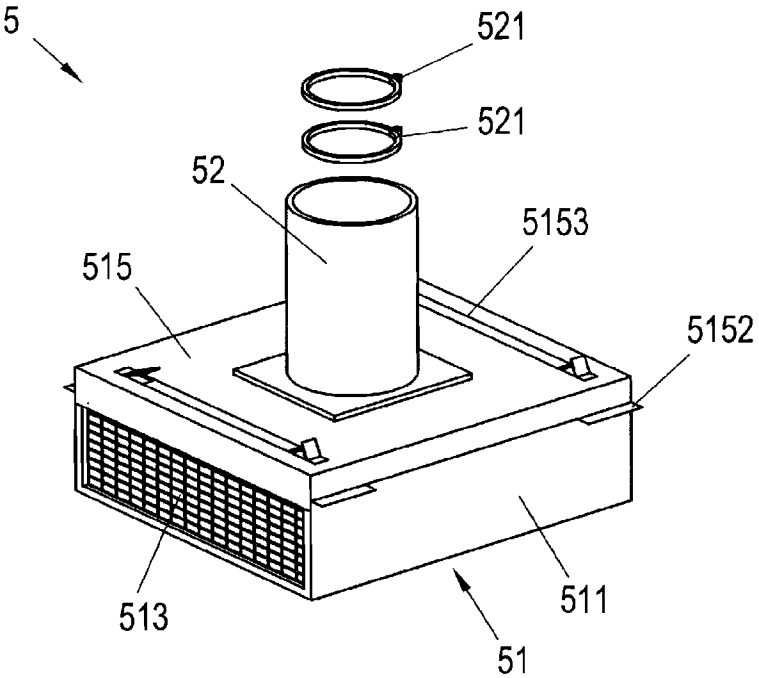
FIG. 4: shows a schematic perspective view of a first embodiment of the air-circulator according to the invention.

Shown in FIG. 4 is a perspective view and in FIG. 5 an exploded view of a first embodiment of the air-circulator 5. The air-circulator 5 has the shape of a shallow rectangular box. The air-circulator essentially consists of a base tray 511 and a lid 515 mounted thereon. A circular air-inlet opening 5151 is provided in the center of the lid 515, on which opening the pipe socket 5155 is placed. A pipe 52 is attached to the pipe socket 5155. Furthermore, two insertion slots 5153 are provided in the lid 515. These insertion slots 5153 run parallel to two opposing edges of the rectangular lid 515 and are adjacent to these edges, i.e. positioned in proximity to these edges. The insertion slots 5153 extend in their length over most of the length of the lid 5153. Access protection grids 513 are provided on the side walls of the air-circulator 5, which side walls are adjacent to the edges, parallel to which the insertion slots 5153 extend. The areas which are covered by the access protection grids 513 are also referred to as air-outlet areas.

As can be seen from FIG. 5, the base tray 511 in the embodiment shown has a U-shape, the base of the U-shape representing the floor of the housing 51. The legs of the U-shape form two opposing side walls of the housing 51. Guiding profiles 512 are set into the base tray 511. These are provided at the corners of the base tray 511 and run vertically. An access protection grid 513 is mounted between two guiding profiles 512 on each of the two open sides of the base tray 511. An odor filter 514 is mounted respectively in the guiding profile 512 behind each access protection grid 513 in the interior of the housing 51. A lid 515 is mounted on the base tray 511. The lid 515 has a tray shape, the floor of the tray closing off top of the interior of the air-circulator 5. The edges of the tray shape are downwardly pointing and grip around the upper region of the side walls of the base tray 511 and of the access protection grids 513. The height of the edges of the lid 515 is small in comparison with the height of the base tray 511. Four outwardly oriented fastening tabs 5152 are provided on the lid 515, in particular on the lower end of the edges of the lid 515.

The odor filters 514 are introduced from above through the insertion slots 5153 in the lid 515 into the interior of the air-circulator 5 and guided and held there by the guiding profiles 512. After the appropriate odor filter 514 has been introduced into the air-circulator 5, the insertion slot 5153 is sealed by means of a sealing strip 5154. This sealing strip may be composed, for example, of plastic, and be connected to the lid 515 of the housing 51 before the introduction of the odor filter 514. As described previously, in the embodiment shown a pipe socket 5155 is mounted on the lid 515, on which pipe socket a pipe 52 is mounted. The pipe 52 can be connected to the pipe socket 5155 by means of a pipe clamp 521 and/or a sealing ring. A pipe clamp 521 can likewise be used for connecting the free end of the pipe 52 to further air-line elements.

The air-circulator 5 constructed in this manner is installed, as shown in FIGS. 1 to 3, in the base unit 2. Here, the base tray 511 with the access protection grids 513 provided therein is accommodated in the plinth 22 of the base unit 2. The lid 515 is held by the fasting tabs 5152 on the floor 23 of the interior 21 of the base unit 2 and can via these fastening tabs 5152 be connected to the floor 23, for example screwed thereto.

This installation and the use of an air-circulator 5 according to the invention make it possible on the one hand for the space required in the interior 21 of the base unit 2 to be kept to a minimum. On the other, the accessibility of the lid 515 from the interior 21 of the base unit 2 makes it possible for access to and thus replacement of the odor filters 514 to be realized even when the air-circulator 5 is in the installed position.

Figure 7:
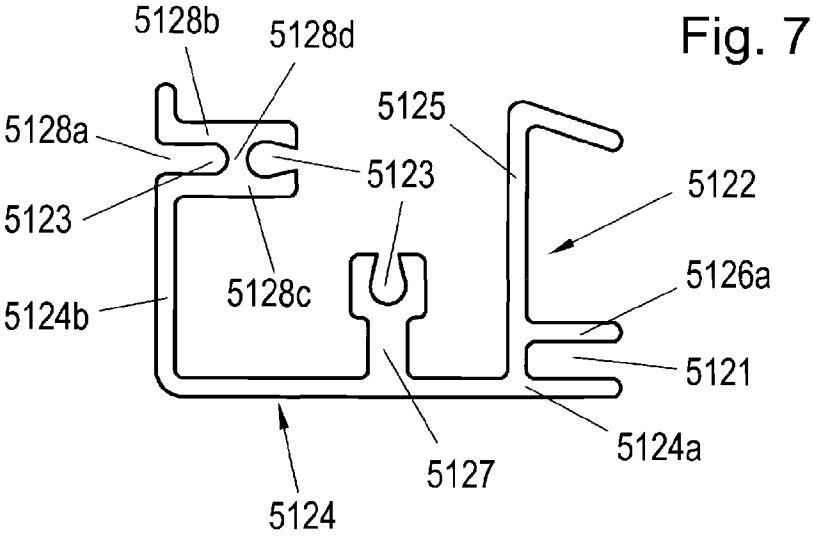
FIG. 7: shows a schematic sectional view of the guiding profile according to FIG. 6.
Figure 6:
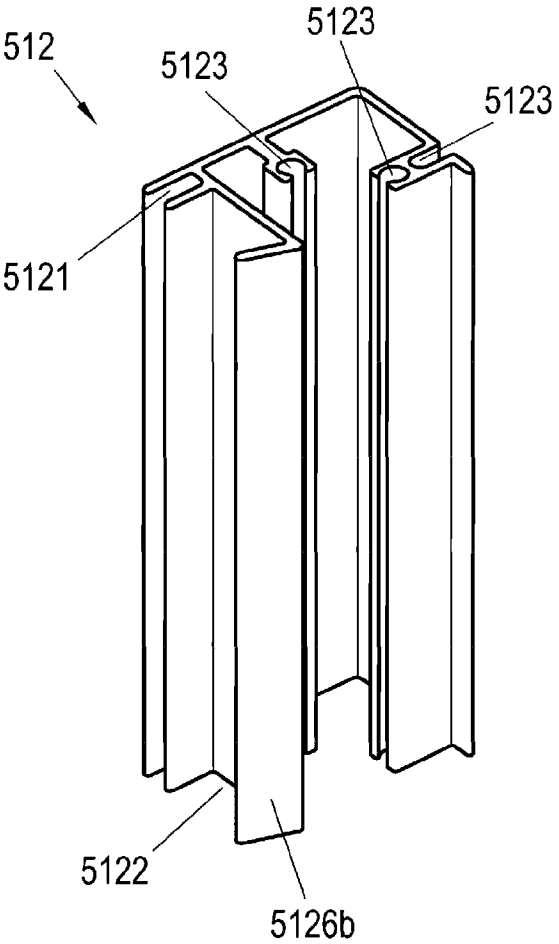
FIG. 6: shows a schematic perspective view of a guiding profile of the air-circulator according to FIG. 4.
Figure 9:
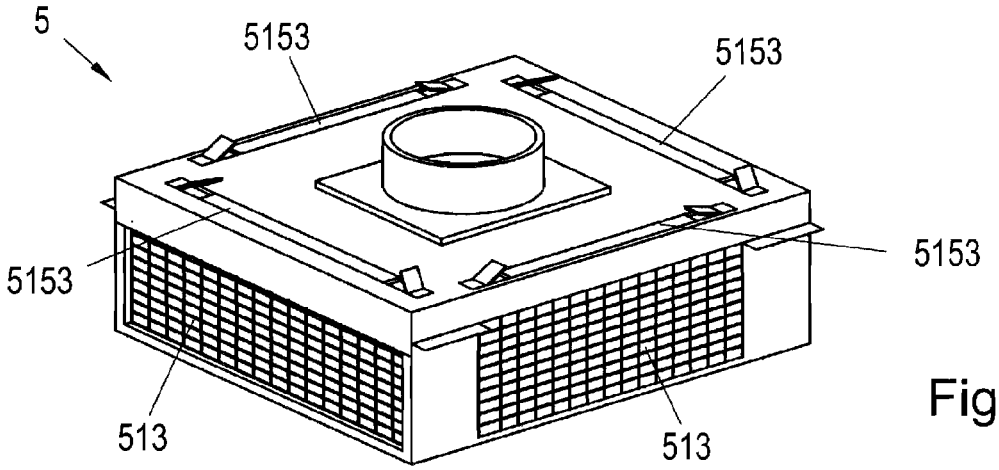
FIG. 9: shows a schematic perspective view of a second embodiment of the air-circulator according to the invention.

The guiding profile 512 which is integrated in the air-circulator 5 has according to one embodiment the form shown in FIGS. 6 and 7. The guiding profile 512 comprises a basic profile 5124 that has an L shape. On the inside of a first longer leg 5124*a* of the L profile 5124 there is provided an inwardly oriented bridge 5125. The bridge 5125 is arranged at a distance from the free end of the first leg 5124*a*, extends perpendicular to the leg 5124 and runs parallel to the free end of the leg 5124. Two projections 5126*a*, 5126*b* are provided on the bridge 5125. These projections 5126*a*, 5126*b* also take the form of bridges. The first projection is provided in the vicinity of the first leg 5124*a* of the L profile 5124. This projection 5126*a* extends parallel to the first leg 5124*a* of the L profile 5124. The second projection 5126*b*, which is also referred to as a holding flange, is provided on the end of the bridge 5125 which is facing away from the first leg 5124*a* of the L profile 5124. This projection 5126*b* is inclined toward the first projection 5126*a*. In particular, the second projection 5126*b* constitutes a flange which is angled or bent away from the end of the bridge 5125 and is inclined in the direction of the first projection 5126*a*.

An inwardly oriented screw channel 5123 is provided between the bridge 5125 and the further leg 5124*b*. This screw channel 5123 is formed by a bridge 5127 on the free end of which a carrier for a screw is provided.

A recess 5128*a* extending over the length of the L profile 5124 is provided on the second leg 5124*b* of the L profile 5124 close to the free end. This recess 5128*a* serves as a further screw channel 5123. The recess 5128*a* changes into two braces 5128*b*, 5128*c* extending in a perpendicular manner from the second leg 5124*b*. These are connected to one another on the floor of the recess 5128*a* by means of a cross brace 5128*d*. The free ends of the two braces 5128*b*, 5128*c* standing at a distance from the cross brace 5128*d*, or the intermediate space formed between these, serves as a further screw channel 5123.

A carrier or guide 5121 for the edge of the access protection grid 513 is formed between the free end of the first leg 5124*a* of the L profile 5124 and the first projection 5126*a*. The carrier or a holder 5122 for the edge of the odor filter 514 is formed between the first and the second projection 5126*a*, 5126*b*. In that the second projection 5126*b* is inclined toward the first projection 5126*a*, the odor filter 514 can be held securely between these two projections 5126*a*, 5126*b*.

The guiding profile 512 can be screwed at the bottom to the base tray 511 and at the top to the lid 515 via the screw channels 5123. The joining of the individual components of the housing 51 of the air-circulator 5 is thus established by means of the guiding profiles 512. The guiding profile 512 may, for example, be an extruded part and be composed of plastic or aluminum.

Figure 8:
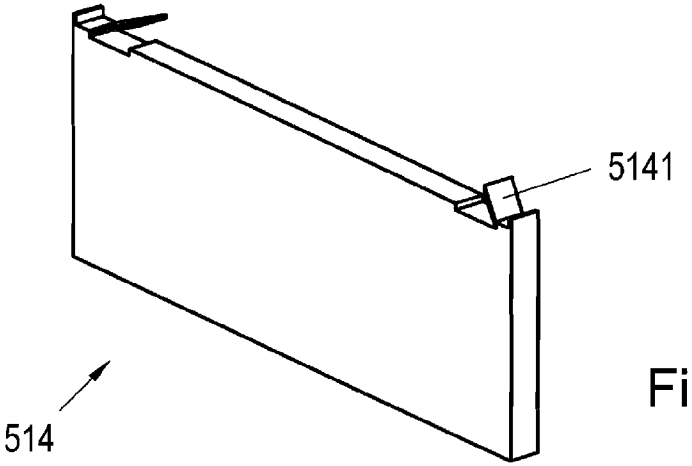
FIG. 8: shows a schematic perspective view of an odor filter of the air-circulator according to FIG. 4.

FIG. 8 shows an embodiment of an odor filter 514. The odor filter 514 has the shape of a rectangular plate. A tab 5141 is provided on the top of the odor filter 514, i.e. on the upwardly oriented edge of the odor filter 514 when the odor filter 514 is in the installed position, close to each of the ends. These tabs 5141 project in one position in an upward manner. The tabs 5141 are flexibly embodied and can be pressed in a further position in a downward manner and end flush with the edge of the odor filter 514. By these tabs 5141, the odor filter 514 can be gripped and held firmly. The tabs 5141 can be fastened directly to the odor filter material. However, it also lies within the scope of the invention for the odor filter material to be held in a frame. This frame may be composed, for example, of plastic. In this case, the tabs 5141 can be provided on the frame of the odor filter 514.

FIGS. 9 to 14 show further embodiments of the air-circulator 5 according to the invention. The embodiments in FIGS. 9, 10 and 11 correspond substantially to the first embodiment which has been described in detail with reference to FIGS. 4 and 5. However, in the embodiment in FIG. 9, rather than two odor filters 514, four odor filters 514 are provided. These are respectively provided adjacent to the four edges of the housing 51 of the air-circulator 5. In this embodiment, there are therefore provided in the lid 515 four insertion slots 5153 which respectively extend parallel to the edges of the lid 515. Access protection grids 513 are arranged on all four sides of the housing 51. The four access protection grids 513 can all, as has been described with reference to the first exemplary embodiment, be held between two guiding profiles 512 respectively. It is, however, also possible for only two opposing access protection grids 513 to be held in guiding profiles 512 and for the other two access protection grids 513 to be integrated into the side wall of the housing 51 such that they are connected to edge strips of the side walls. Thus, in the second embodiment in FIG. 9, optionally no base tray 511 is used but a base sheet or a base plate on which edge strips project upwardly.

Figure 10:
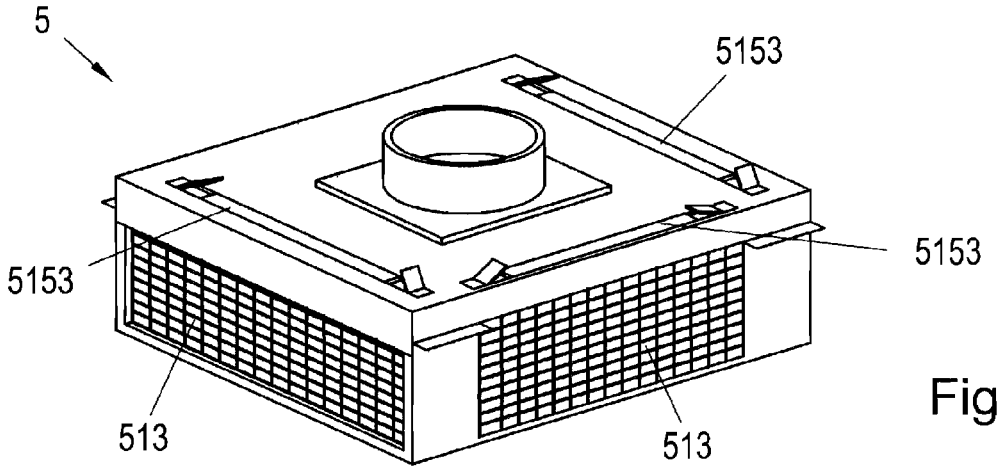
FIG. 10: shows a schematic perspective view of a third embodiment of the air-circulator according to the invention.
Figure 11:
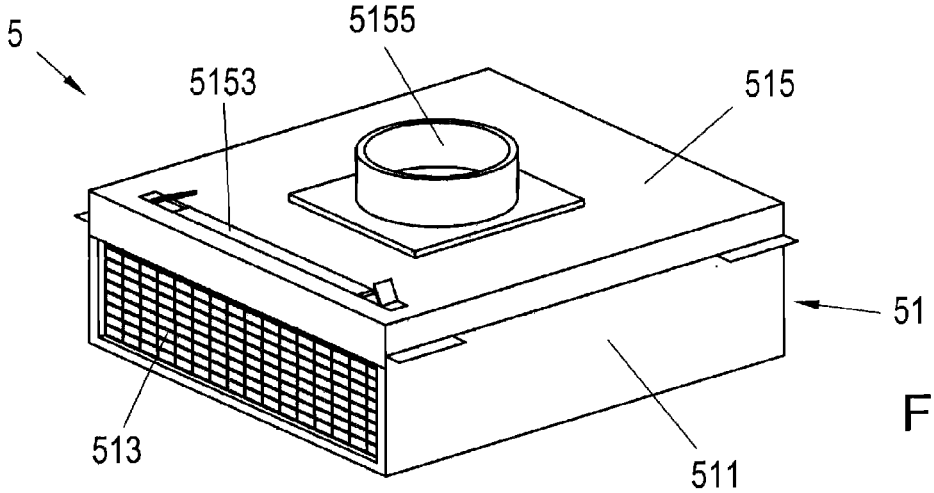
FIG. 11: shows a schematic perspective view of a fourth embodiment of the air-circulator according to the invention.

In the embodiment according to FIG. 10, only three odor filters 514 are provided. In this embodiment, too, the arrangement of the odor filters 514 and, correspondingly, the arrangement of the insertion slots 5153 are parallel to the side walls of the housing 51 of the air-circulator 5. In this embodiment, too, preferably at least two of the access protection grids 513 which are arranged in front of the odor filters 514 and serve as air outlet openings, are held in guiding profiles 512. The third access protection grid 513 can be integrated into the side wall of the housing 51 of the air-circulator 5. Finally, FIG. 11 shows an embodiment in which only one odor filter 514 with an access protection grid 513 arranged in front thereof is provided. The other side walls of the housing 51 of the air-circulator 5 are closed. In this embodiment, the odor filter 514 and the access protection grid 513 are preferably held between two guiding profiles 512.

Figure 12:
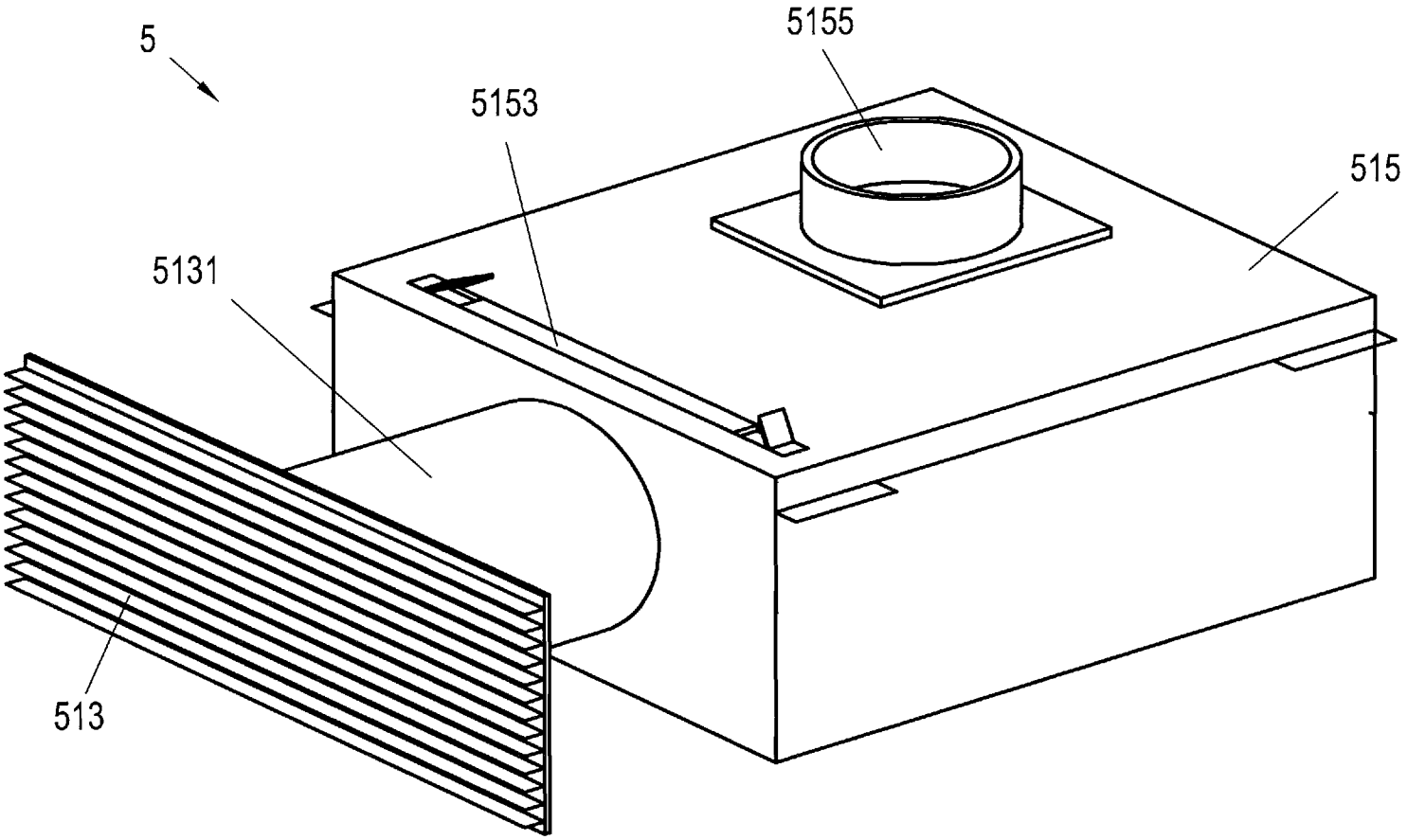
FIG. 12: shows a schematic perspective view of a fifth embodiment of the air-circulator according to the invention.

FIG. 12 shows an alternative embodiment. In this embodiment, an odor filter 514 is also provided. However, the access protection grid 513 which is assigned to this odor filter 514 is not provided directly in the side wall of the housing 51 of the air-circulator 5. Rather, a feeder pipe 5131 is provided on the side wall of the housing 51, which feeder pipe connects the housing 51 to an air outlet located at a distance. The air outlet has a larger area than the diameter of the feeder pipe 5131. In the embodiment shown, the air outlet is formed by a container with a rectangular outlet area. An access protection grid 513 or another grid is provided on the outlet area. Although only one feeder pipe 5131 with corresponding air outlet is shown in the Figure, it lies within the scope of the invention for corresponding feeder pipes 5131 to be provided on several of the side areas of the housing 51 of the air-circulator 5, which feeder pipes are each connected to corresponding air outlets.

Figure 13:
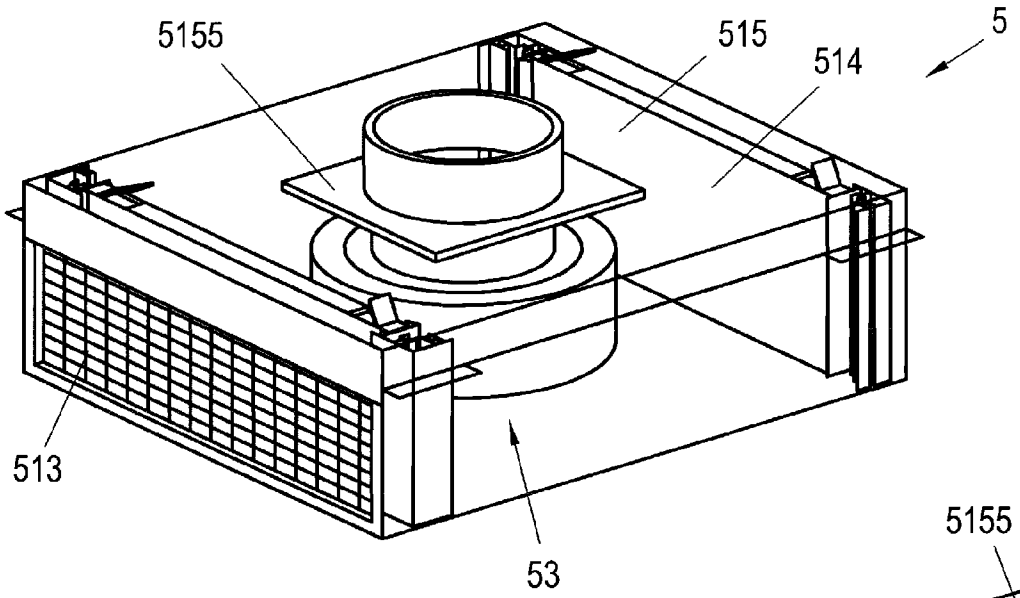
FIG. 13: shows a schematic perspective view of a sixth embodiment of the air-circulator according to the invention.

FIG. 13 shows a further embodiment of the air-circulator 5 according to the invention. The lid 515 and one of the side walls of the housing 51 are represented transparently in FIG. 13 in order to allow an insight into the interior of the air-circulator 5. This embodiment corresponds substantially to the embodiment shown in FIG. 4. However, in the embodiment according to FIG. 13, a fan 53 is provided in the interior of the housing 51. By means of this fan 53, air is sucked in through the pipe socket 5155 and a pipe optionally fastened thereto (not shown) into the air-circulator 5 and blown out through the odor filter 514 and the access protection grid 513. The fan 53 is a radial fan so the height of the fan 53 can be kept low to suit the height of the air-circulator 5.

Figure 14:
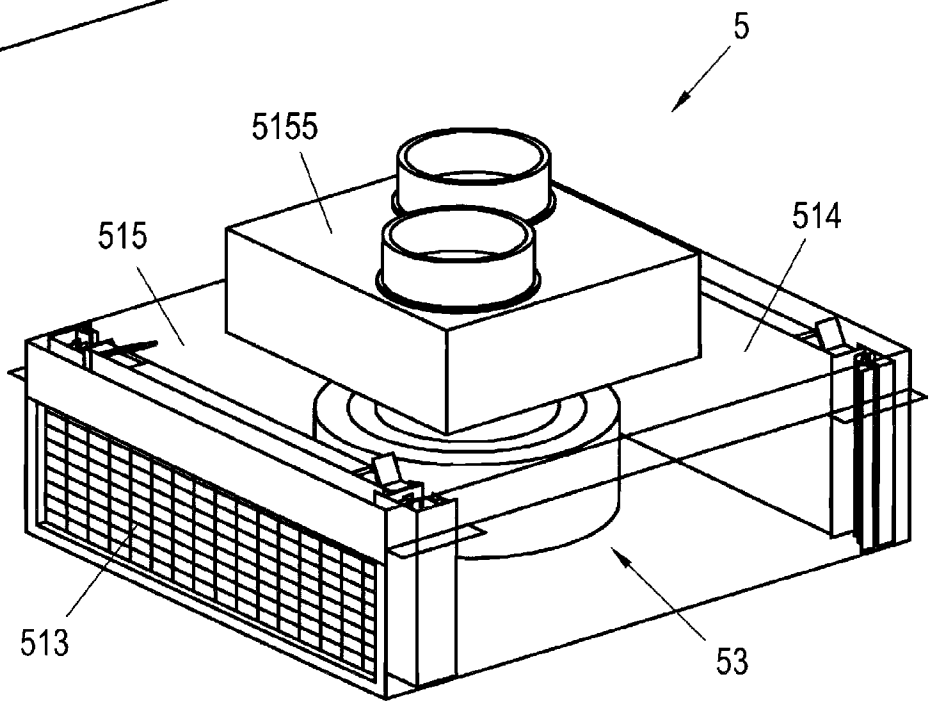
FIG. 14: shows a schematic perspective view of a seventh embodiment of the air-circulator according to the invention.

FIG. 14 shows a further embodiment of the air-circulator 5 according to the invention. This embodiment corresponds to the embodiment shown in FIG. 13. In particular, a fan 53 is also provided in this embodiment in the housing 51. However, the pipe socket 5155 in the embodiment according to FIG. 14 is designed such that two pipes can be connected via this socket to the air-circulator 5. Such an air-circulator 5 can be used for example with fume extractors 1 in which two separate suction areas 11 are provided. These can be arranged for example vertically to the left and to the right of a hob 3.

The air-circulators 5 shown in FIGS. 4 to 14 can be integrated within a base unit 2, the base tray 511 or a base plate with the guiding profiles 512 fastened thereto and the access protection grids 513 inserted into the guiding profiles 512 being embedded into the floor 23 of the base unit 2. The base tray 511 is in this position largely accommodated in the plinth 22 of the base unit 2. Before the base tray 511 is introduced into the plinth, the lid 515 is preferably mounted on the base tray 511 and screwed via the guiding profiles 512 to the guiding profiles and thus to the base tray 511. In the inserted position in the plinth 22, the fastening tabs 5152 of the lid 515 lie on the floor 23 of the base unit 2. Via these, the air-circulator 5 can be screwed to the floor 23. Via the insertion slots 5153, the odor filters 514 can be inserted into the housing 51 of the air-circulator 5.

The air-circulator 5 can be provided in the same base unit 2 in which the fume extractor 1 and the hob 3 are integrated. However, it is also within the scope of the invention for the air-circulator 5 to be integrated in a base unit 2 which is adjacent to the base unit 2 in which the fume extractor 1 is provided. The insertion of the air-circulator 5 in a base unit 2 that is separated from the base unit 2 of the fume extractor 1 by further base units 2 is also within the scope of the present invention. The connection of the air-circulator 5 and of the fume extractor 1 in particular of a duct that is connected to the suction area 11, can be formed by a pipe or a hose.

The present invention is not restricted to the embodiments shown. In particular, individual features of one embodiment can also be combined with the further features of a different embodiment without all the further features shown in connection with the individual feature necessarily having to be implemented.

For example, the pipe socket which is shown in FIG. 14 and to which two pipes can be connected can also be provided on an air-circulator in which no fan is provided or which has a larger or smaller number of odor filters and access protection grids and thus air-outlet areas. Furthermore, in the embodiments in which more or fewer than two odor filters with corresponding air-outlet surfaces are provided, can also have a fan in the interior.

The shape of the housing or the structure of the housing may also deviate from the embodiments shown.

A range of benefits can be achieved with the fume extractor according to the invention and the air-circulator according to the invention. Thus, firstly, ease of assembly is provided by the shape and the concept for the fastening of the air-circulator on a cabinet and of the individual parts of the air-circulator in the air-circulator. In addition, by virtue of the fact that the housing of the air-circulator is installed in the plinth of the base unit, no change to the dwelling is required. In particular, by virtue of the air-circulator, there is no need for air-extraction pipework. The insertion slots in the lid of the housing of the air-circulator, together with the guiding profiles make it possible for the filter medium to be changed quickly and easily. In that the carrier of a fan is provided, or can be provided, with the same sheet parts modules can be constructed which provide purely an air-circulating solution with external blower or alternatively, with a built-in fan, offer an all-in-one solution. The shape of the guiding profile, which can consist of aluminum, allows fast filter changing and at the same time screwing to the sheet parts as well as insertion of the access protection. The space-saving arrangement in the base unit, in particular in the plinth of the base unit makes it possible for the remaining space to be used as possible storage for pots and pans, for example. Since the cleaned air is discharged inside the plinth of the kitchen furniture, the point of discharge can be set arbitrarily. For example, the point of discharge of the air out of the kitchen furniture may be several meters away from the air-circulator itself. An annoying draught of air during cooking can be prevented by this means. The invention permits arbitrary combinations, optionally comprising one or more filters. Furthermore, when being changed the filter medium can be held by means of the tabs attached thereto. Contact between the hands and the filter itself, and contamination of the hands thereby, can be avoided by this means. Finally, the invention provides options for connecting several exhaust elements and thereby further increases the flexibility of use of the air-circulator.

The invention claimed is:

1. An air-circulator comprising:

a housing sealed on a bottom area thereof, the housing having a plurality of sides and a top above the plurality of sides, the housing having a lid that forms at least a portion of the top of the housing, the lid having an upper surface, the housing having an air inlet opening in the upper surface of the lid, an air outlet opening in one of the sides of the housing, an odor filter having an edge profile, and an insertion opening in the upper surface of the lid for inserting the odor filter into the housing, wherein the odor filter is dedicated to the air outlet opening, wherein the housing has a pair of vertically extending opposed guiding profiles with each guiding profile defining a filter channel adapted to support the odor filter, the guiding profile including an end wall, a first projection extending generally perpendicularly from a first portion of the end wall and a second projection extending obliquely from a second portion of the end wall, wherein the second projection is inclined toward the first projection for contact with the filter along a side of the first projection and an edge of the second projection whereby the odor filter is held between the first projection and the second projection.

2. The air-circulator of claim 1, wherein the insertion opening is rectangular with a first dimension and a second dimension, the odor filter has a height, a width, and a thickness, the thickness being less than the height, and the thickness being less than the width, and the width of the odor filter is substantially equal to the first dimension of the insertion opening, and the thickness of the odor filter is substantially equal to the second dimension of the insertion opening.

3. The air-circulator of claim 1, wherein the guiding profile has a carrier formed as a second channel adjacent and generally parallel with the filter channel for guiding a protective grid.

4. The air-circulator of claim 1, wherein the lid has an fastener for fastening to a floor of a cabinet.

5. The air-circulator of claim 1, wherein the housing further comprises a base which has a height that generally corresponds to a height of a plinth of a cabinet.

6. The air-circulator of claim 1, wherein the air-circulator further comprises a fan which is disposed in the housing of the air-circulator.

7. A fume extractor for sucking contaminated air from a room and cleaning the air, the fume extractor comprising:

a suction area;

an air-circulator having a housing with an air inlet opening in fluid communication with the suction area and an air outlet opening in fluid communication with the inlet opening, the housing having a plurality of sides and a top above the plurality of sides, the housing having a lid that forms at least a portion of the top of the housing, the lid having an upper surface;

an odor filter disposed intermediate the air inlet opening and the air outlet opening, the air-circulator including an insertion opening for inserting the odor filter in the housing, the odor filter having a tab movable between a position flush with the odor filter and a position where the tab projects outwardly from an outer edge of the odor filter for removal of the filter from the housing;

a pair of vertically extending opposed guiding profiles inside the housing, each guiding profile defining a filter channel for supporting the odor filter, and including an end wall, a first projection extending generally perpendicularly from a first portion of the end wall and a second projection extending obliquely from a second portion of the end wall, the second projection being inclined toward the first projection for contact with the filter along a side of the first projection and an edge of the second projection; and an air supply line in fluid communication with the air-circulator, wherein the insertion opening is in the upper surface of the lid, the air inlet opening is in the upper surface of the lid, and the air outlet opening is in one of the sides of the housing.

8. The fume extractor of claim 7, wherein the air-circulator comprises a fan disposed within the housing in operative communication with the air inlet opening and the air outlet opening that sucks air in via the suction area.

9. The fume extractor of claim 7, wherein the fume extractor comprises a vertical suction area connected to a downwardly oriented air duct.

10. The fume extractor of claim 7, wherein the odor filter is closely adjacent the air outlet opening.

11. The fume extractor of claim 7, wherein the fume extractor is built into a base unit of a row of kitchen units and the air-circulator is disposed in a plinth of one of the base units of the row of kitchen units.

12. An air-circulator for disposition under a host cabinet, the host cabinet supporting a hob, the air-circulator comprising:

a housing sealed on a bottom area thereof, the housing having a plurality of sides and a top above the plurality of sides, the housing having a lid that forms at least a portion of the top of the housing, the lid having an upper surface, the housing having an air inlet opening, an odor filter, and an insertion opening for inserting the odor filter into the housing, a pair of vertically extending opposed guiding profiles inside the housing, each guiding profile defining a filter channel for supporting the odor filter, and including an end wall, a first projection extending generally perpendicularly from a first portion of the end wall and a second projection extending obliquely from a second portion of the end wall, the second projection being inclined toward the first projection for contact with the filter along a side of the first projection and an edge of the second projection; and an air outlet opening covered by a protection grid spaced from the housing and the odor filter, the air outlet opening being adjacent a wall of the host cabinet and connected to the housing with an elongate feeder pipe, the feeder pipe extending between the filter and the air outlet opening, wherein the air outlet opening is configured for lateral air discharge outwardly away from the host cabinet and wherein the odor filter is dedicated to the air outlet opening, wherein the insertion opening is in the upper surface of the lid, and the air inlet opening is in the upper surface of the lid.

13. The air-circulator of claim 12 wherein the guiding profiles each form a corner of the housing.

* * * * *